United States Patent [19]

Miller et al.

[11] Patent Number: 4,606,473

[45] Date of Patent: Aug. 19, 1986

[54] READILY REPAIRABLE AND LIGHTWEIGHT INSULATING COVER FOR A HEATED METAL CONTAINER

[75] Inventors: Thomas M. Miller, North Olmsted; Raymond J. Schraff, Cleveland, both of Ohio

[73] Assignee: Eltech Systems Corporation, Boca Raton, Fla.

[21] Appl. No.: 754,479

[22] Filed: Jul. 12, 1985

Related U.S. Application Data

[62] Division of Ser. No. 656,826, Oct. 2, 1984, Pat. No. 4,530,441.

[51] Int. Cl.[4] ..... B65D 6/10

[52] U.S. Cl. ..... 220/215; 52/245; 52/227

[58] Field of Search ..... 220/215, 414; 432/247; 52/245, 227

[56] References Cited

U.S. PATENT DOCUMENTS

| | | | |
|---|---|---|---|
| 3,140,792 | 7/1964 | Harris | 220/215 |
| 3,743,132 | 7/1973 | Larker et al. | 220/215 |
| 4,168,013 | 9/1979 | King et al. | 220/414 |
| 4,195,457 | 4/1980 | Kisshing et al. | 52/245 |
| 4,405,055 | 9/1983 | Koerdt et al. | 220/215 |
| 4,411,621 | 10/1983 | Miller | 432/247 |

FOREIGN PATENT DOCUMENTS

EP800013 11/1980 PCT Int'l Appl. .

OTHER PUBLICATIONS

Vallak Thermo Covers Commercial Brochure.
Construction Drawings for Commerical Ladle Cover.

*Primary Examiner*—George T. Hall
*Attorney, Agent, or Firm*—John J. Freer

[57] ABSTRACT

A lightweight cover provides heat insulation for a heated metal container, e.g., a ladle. The insulation cover is assembled in a manner providing for ease of repair plus simplicity of maintenance. The assembly has a frame member with depending guide means useful for straddling engagement with the container. Frame member impact assemblies provide resilient mounting of the cover on the container. Ceramic fiber insulation is placed within the frame and abuts upwardly against a roof over the insulation. The insulation is secured to the roof. Stiffeners above the roof connect with the frame member. The entire insulation cover assembly is most particularly useful for retarding radiant and conductive heat loss from the container.

26 Claims, 5 Drawing Figures

READILY REPAIRABLE AND LIGHTWEIGHT INSULATING COVER FOR A HEATED METAL CONTAINER

This is a division of application Ser. No. 656,826, filed Oct. 2, 1984; now U.S. Pat. No. 4,530,441.

BACKGROUND OF THE INVENTION

A variety of high temperature insulating structures have been proposed for use in the heavy metals industries, e.g., the steel industry. As an example, an insulation container adapted for placement over a hot metal ingot has been proposed in U.S. Pat. No. 4,168,013. The container comprises inner and outer walls which are spaced apart for containing insulation. The insulation comprises layers of thin, reflective radiation foil shields which are themselves spaced apart by fibrous ceramic layers.

In a contemporaneous development, ingot molds can be fabricated to have layered upper sections. The upper, inner wall is formed from a plate of material capable of withstanding hot metal contact. This inner wall is spaced apart from the wall of the mold. Then, as discussed in International Patent Application No. PCT/EP80/00131 the interior space can be filled with a compressible insulation filler such as a ceramic fiber insulation.

In pit-type heat soaking of ingots, cover structures have been proposed which employ mats of ceramic fiber insulating material. Thus in U.S. Pat. No. 4,411,621 it has been shown to support such fibrous mats by securing them to a metal mesh cover, such as by wire ties. The structure can find use as a furnace wall or soaking pit cover.

It has also been proposed to cover bottle type ladle cars by the use of ceramic fiber blankets that are covered, top and bottom, by metal mesh. Fasteners are positioned through the blankets and secure the opposing metal mesh covers one with the other. The resulting structure can then be fastened to the open top of a bottle type ladle car, such as by wire ties.

It has heretofore been proposed to cover hot ladles using a lid with metal mesh just on top. The opposing surface of such cover is simply ceramic fiber. The fiber is in two layers, with the top layer being secured to the top metal mesh. The lower fiber layer is mortar-bonded to the upper layer to provide for a well sealed ladle cover. Rigid ceramic legs within the fiber can be useful for supporting the cover structure on the ladle.

It would however be most desirable to assemble a cover structure having sufficient strength and durability for repeated mill use. It would also be most desirable if such a structure provided not only ease of assembly, but also ease of repair. It would also be highly advantageous to have the structure resistant to deleterious degradation of its fiber elements, such as can accompany the offgassing of container contents. It would furthermore be advantageous if such cover structure could be easily placed upon and removed from the container.

SUMMARY OF THE INVENTION

Such objects have now been accomplished by means of the present invention. A lightweight insulation cover is now provided which features ease of assembly. Moreover, the cover is particularly adapted for ease of disassembly and repair. The cover exhibits highly desirable durability in repeated, rough mill use, such as when employed as a ladle cover and yet can be readily positioned in place, as well as removed, from the ladle. The cover is particularly useful for substantially reducing radiant heat as well as conductive heat loss, e.g., from the upper surface of a bottle car, teeming ladle, ladle drier or ladle pre-heater, tundish or ingot mold.

The present invention is thus particularly directed to a lightweight insulation cover adapted for retaining heat in a heated metal container, which cover comprises a frame member sized at least substantially to the upper aperture of a heated metal container; frame member guide means having depending elements projecting downwardly away from the frame member for straddling engagement with the outer top of the heated metal container; frame member impact assemblies, with each assembly containing a depending leg, resiliently mounted within the assembly and terminating downwardly in a foot aligned for resting engagement upon the container; ceramic fiber insulation filler in form-stable condition within the frame member; and support means for securing the insulation filler within the frame member.

In another aspect the present invention is directed to a covered ladle assembly having the hereinabove described insulation cover. In a still further aspect the present invention is directed to a cover structure wherein a frame member has at least one impact assembly containing a depending leg resiliently mounted therein and penetrating in to a support foot, which leg can be within a coaxial support member.

DESCRIPTION OF THE PREFERRED EMBODIMENTS

Ceramic fiber insulation will be useful for purposes of the present invention so long as it is available in some form-stable condition, i.e., as opposed to merely loose fibers. To provide form-stable condition, it can be expected that individual fibers will have been brought together in matrix form, such as by felting or weaving operation or the like. When in such form, the insulation can be supplied in units.

For convenience, individual ceramic fiber insulating units will generally be referred to herein as "blankets", but it is to be understood that the words "batts" and "mats" may also be used to refer to such units. By use of the term ceramic fiber "module", reference is being made to a unit of interengaged blankets, such as prepared by stitching together adjacent blankets or by interengaging such blankets by inner support means. It is also to be understood that the word "wall", or the term "wall-type", as used herein are meant to include any structure, be it a wall, lid, roof or cover, that presents a generally planar surface to a heating zone and is useful in some manner in the confining of heat within the zone.

The heated metal container for which the cover will find use can be generally any such container wherein a planar, or at least substantially planar, cover will be useful. The metal container may be heated by containing hot solid metal, e.g., a steel ingot, or by containing molten metal, such as a ladle into which molten steel or molten aluminum, for example, has been poured. In general, the ceramic fiber insulation filler in the cover will be useful at interior cover temperatures on the order of 650° C. or even greater. Thus the cover is contemplated for use with containers which can withstand such temperatures. In commercial practice, use of the invention for covering of containers for metals and alloys that melt or are heat treated at such temperatures, is most contemplated. Moreover, the cover will necessarily be most serviceable over containers wherein guide posts can be best employed in aligning the cover over the container and wherein impact assemblies can rest on container structure or the like for providing a resilient mounting over the container. It can be appreciated that the cover is thus most particularly adapted as a lid for a container holding elemental metals or alloys.

Figure 1:
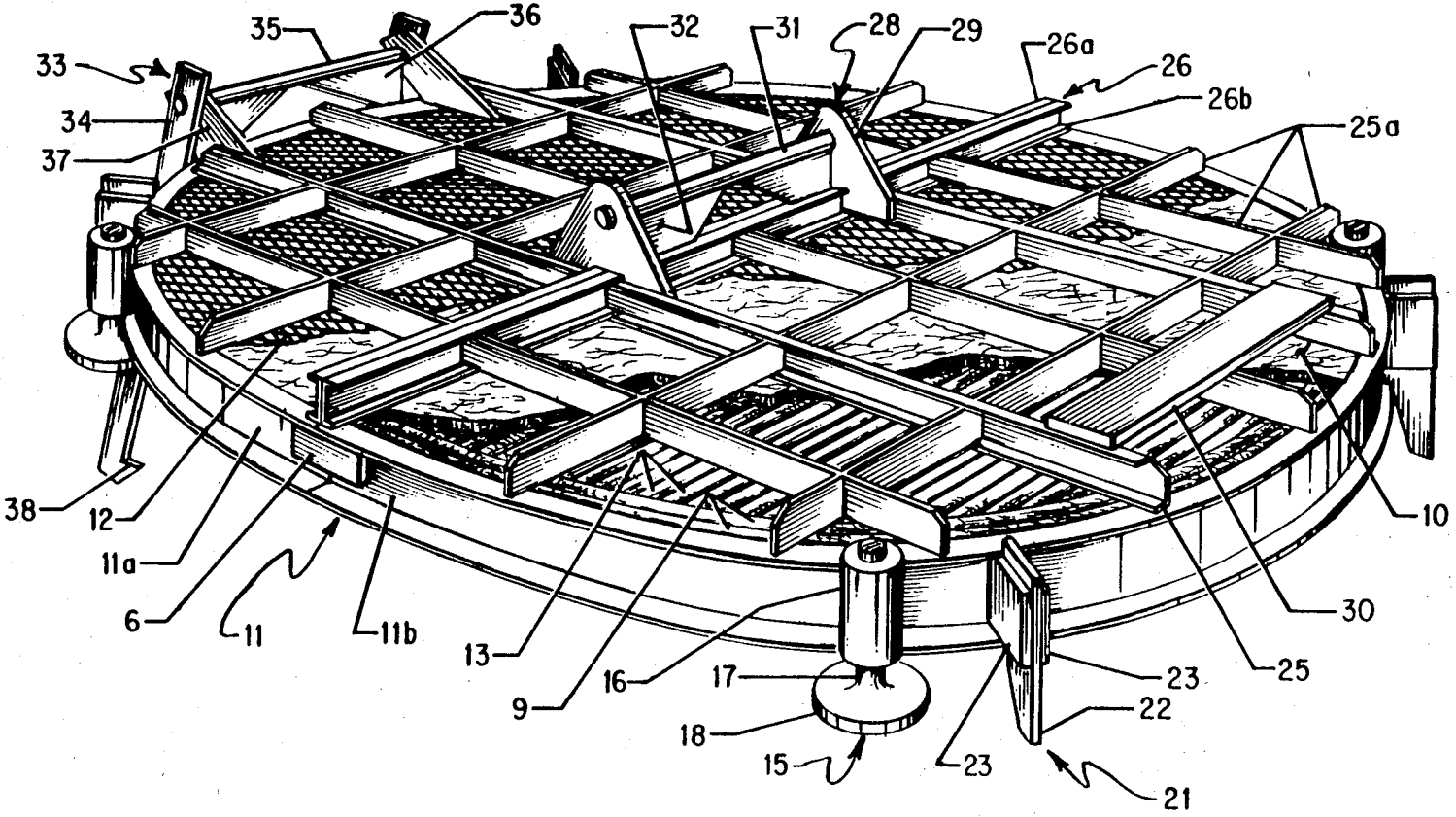
FIG. 1 is a top perspective view of a jointed cover constructed in accordance with the present invention.

Referring now in greater detail to the drawings, FIG. 1 is a perspective view from above the edge of a cover for a heated metal container and most particularly for use in covering a ladle. A curved frame member 11 forms the general outer shape of the cover and is sized at least substantially to the outer top edge of a heated metal container. Since the depicted cover is a jointed cover, the frame member 11 is supplied as two, mirror image frame member half sections 11*a* and 11*b* joined at their abutting ends with tie plates 6. Across the top of the frame member 11 there is secured a sheet 12 of foraminous metal, shown in partial section. Ceramic fiber insulation filler beneath the foraminous metal sheet 12 is composed primarily of an overlay mat 10 plus a series of elongated and folded, typically U-shaped or S-fold interlocked, main area ceramic fiber mats 13. The mats 13 are in snug, side-by-side relationship.

Just inside the curved frame member 11, and in contiguous relationship with such frame member 11 are a few ceramic fiber perimeter mats 9 of typically U-shape or S-shape. These perimeter mats 9 are in snug relationship with one another and with the frame member 11. The main area mats 13 are then pressed snugly at their ends against the perimeter mats 9. All mats 10, 13 and 9 are woven from ceramic fiber insulating material and in combination these mats 9, 10 and 13 fill the interior aperture created by said frame member 11. Each of the ceramic fiber shaped or folded mats 13 has planar parallel leg sections, not shown. Each main area and perimeter mat 13 and 9 abuts against the overlay mat 10. The ends of the mat leg sections, not shown, depend downwardly towards the heated metal container body, also not shown. Securing means, not shown, connect the perimeter and main area mats 9 and 13 with the foraminous metal sheet 12 and thereby maintain the overlay mat 10 in place.

Spaced along the frame member, impact assemblies 15 are securely fastened to the frame member 11, e.g., by welding thereto. Each impact assembly 15 has an assembly housing 16 and a depending shaft or leg 17 which terminates in, and preferably penetrates into, a foot 18. The depending shaft 17 is resiliently mounted, by means not shown, within the assembly housing 16.

Nearby to the impact assemblies 15, and spaced along the frame member 11, are guide means 21. The guide means 21 have depending leg members 22 which are securely fastened to the frame member 11 by means of flanges 23. Atop the foraminous metal sheet 12 are a plurality of rigid primary stiffeners 25 plus secondary stiffeners 25*a* which at their ends are attached, as by welding, to the frame member 11. The open framework of stiffeners 25 and 25*a* are spaced upwardly apart from the foraminous metal sheet 12 and provide support for such sheet 12 by connection means, not shown. To facilitate assembly of the jointed cover, as well as disassembly for repair or refurbishing, the frame member 11 is in two sections. In like manner, the central stiffener 26 is formed from two facing half members 26*a* and 26*b* which can be brought together when the two frame member half sections 11*a* and 11*b* of the cover are brought together for assembly of the complete unit.

At the generally central zone of the top of the cover is a lifting unit 28. The unit 28 is comprised of two opposing end plates 29 which are each securely affixed at their base to a primary stiffener 25 such as by being bolted thereto. Towards the upper end of each end plate 29 and bridging between these plates 29 is a lifting bail 31. The bail 31 is supported underneath and at each end by a gusset plate 32 secured to its adjacent end plate 29, as by welding. At one area of the cover adjacent the guide means 21 but atop the stiffeners 25 and 25*a* is a counterweight 30 which can be affixed to the stiffeners 25 and 25*a* such as by welding.

At the end of the cover opposite the counterweight 30, and virtually always useful when the counterweight 30 is absent, is a side lifting unit, shown generally at 33, as an especial adaptation when the cover is to be used for side tipping, such as with a ladle. The lifting unit 33 is comprised of two opposing legs 34 which are each affixed near their upper end to a lifting bail 35. The legs 34 may be affixed to the frame member, or alternatively, may be free to swing away from the frame member 11. The lifting bail 35 bridges between these legs 34. The bail 35 is supported by braces 37 at each end, as well as supported underneath and at each end by a gusset plate 36 secured to its adjacent brace 37, as by welding. The braces 37 support each leg 34 with an adjacent stiffener 25. At their lower end, each leg 34 terminates in a hook projection 38 that is useful, for example, for grasping an outer rim of a ladle, not shown. By means of such a lifting unit 33, the cover can grasp and cover the ladle or similar heated metal container, when such container is tipped, or the cover in the alternate mode can be free to be ajar from the container in such position.

Figure 2:
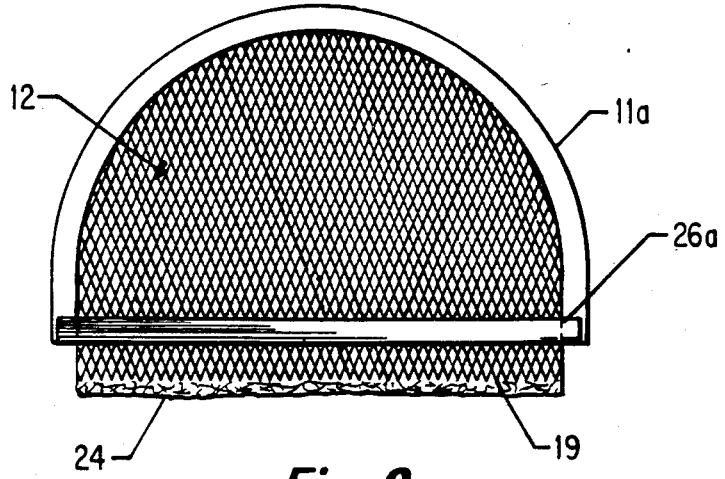
FIG. 2 is a top view of a half section of selected elements of a jointed cover showing a metal mesh edge extension.

In FIG. 2 a top view depicts selected elements of a first half section of a jointed cover. More particularly, a somewhat semicircular frame member half section 11*a* forms the outer periphery of the somewhat semicircular cover first half section. Over the otherwise hollow portion created by the frame member half section 11*a* is a foraminous metal sheet 12. This sheet 12 has a protruding metal sheet section 19 that extends away from the frame member half section 11*a* as well as away from the edge of a central stiffener half member 26*a* at the edge of the half section. Under the metal sheet 12 and extending outwardly a short distance from under the protruding metal sheet section 19 is a portion of insulating mats 24.

Figure 3:
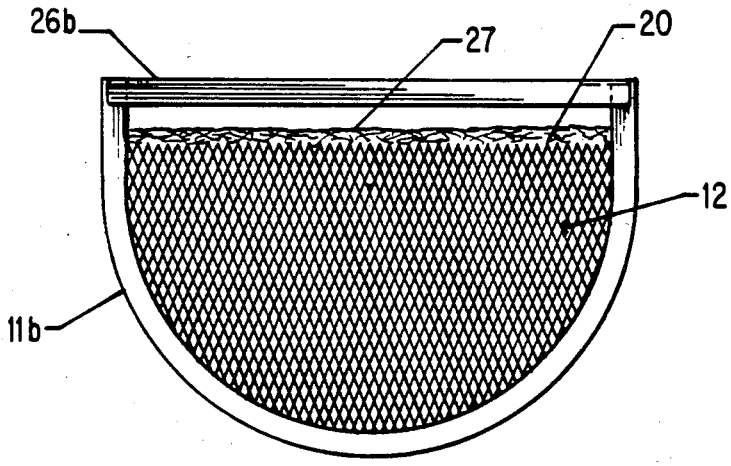
FIG. 3 is a top view of a portion of a cover half section for connection with the half section of FIG. 2 and showing a metal mesh edge recess.

Referring then to FIG. 3, only selected elements of a cover second half section of a jointed cover are depicted. Such second half section as shown is for assembly with the first half section of FIG. 2 for forming a complete cover. More particularly in FIG. 3, a somewhat semicircular frame member half section 11*b* is covered by a foraminous metal sheet 12. At its open end, the frame member half section 11*b* is bridged by a central stiffener half member 26*b*. The foraminous metal sheet 12 has a recessed section 20, recessed away from the central stiffener half member 26*b*. Extending outwardly from under the recessed section 20, is an extending portion 27 of fiber mats. This recessed section 20 provides, in assembly with the cover first half section of FIG. 2, for integration of the protruding metal sheet section 19 of FIG. 2 with the recessed metal sheet section 20 of FIG. 3.

Figure 4:
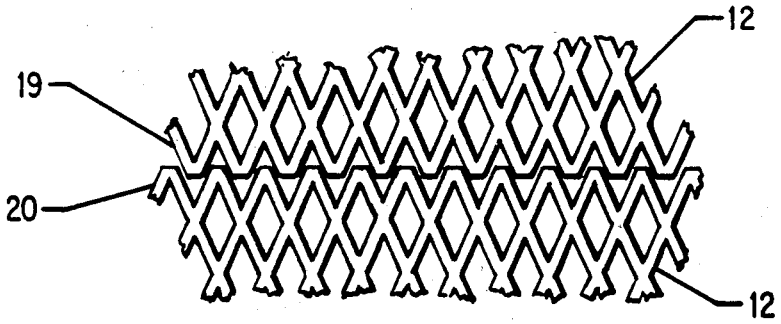
FIG. 4 is an enlarged sectional view of edge detail in the joining of the metal mesh of FIGS. 2 and 3.

This integration of metal sheet sections 19 and 20 is shown in more detail in the enlarged sectional view of FIG. 4. Referring more particularly to the metal sheet edge detail shown in FIG. 4, the foraminous metal of the protruding metal sheet section 19 from FIG. 2 is shaped so as to form a contiguous mating assembly with the shape of the recessed foraminous metal sheet section 20 of FIG. 3. By such joining, a continuous foraminous metal sheeting cover will be provided over the ceramic fiber insulation filler of the cover. Moreover, by such joining the extending mat portions 24 and 27 will be compressed together to form a snug, insulating seal between the cover members.

Figure 5:
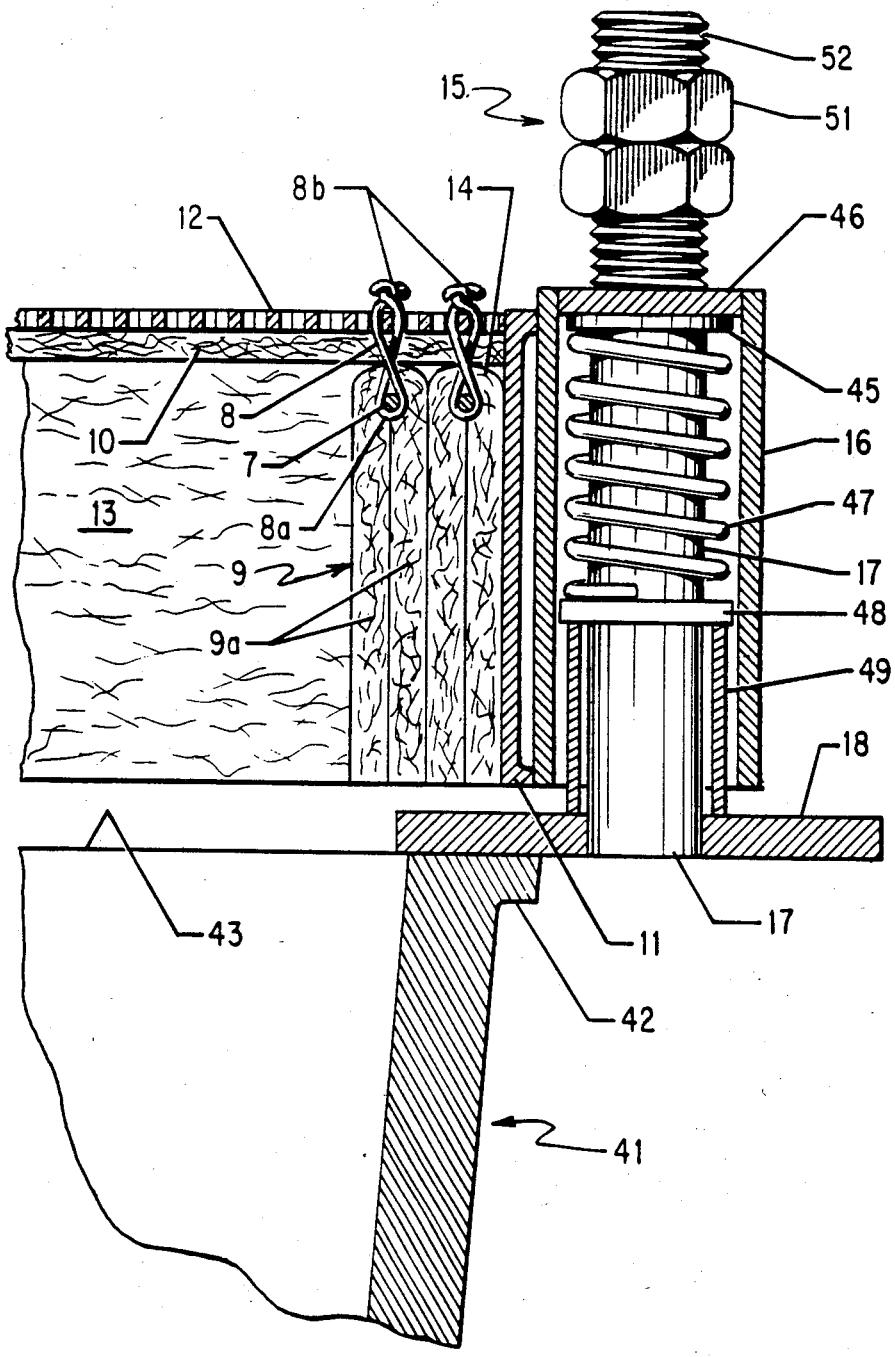
FIG. 5 is a cross-sectional elevation view of an impact assembly portion of a cover including container cover and body portions.

In FIG. 5 the frame member 11 is shown in section as is the foraminous metal sheet 12. As more particularly depicted in the figure, abutting against the frame member 11, and running along such member 11 are the ceramic fiber perimeter mats 9. These perimeter mats 9 running along the inner facing of the frame member 11 provide for augmented sealing against heat loss. Abutting snugly up against the perimeter mat 9 spaced furthest apart from the frame member 11 are main area mats 13. Atop the main area mats 13 and perimeter mats 9 is an overlay mat 10. As with the main area mats 13, the perimeter mats 9 have planar parallel leg sections 9*a* and an integral bridging mat portion 14. The perimeter mats 9 as well as the main area mats 13 are securely connected to the foraminous metal sheet 12 by means of steel support rods 7 and tie wires 8. More particularly, the rods 7 extend horizontally between the leg sections 9*a* of the perimeter mats 9 adjacent to their bridging portions 14. The tie wires 8 have a bight portion 8*a* extending around the corresponding rod 7 and outer ends 8*b* which extend through the respective mat bridging portion 14 and the overlay mat 10 and are twisted about one another around and above a portion of the foraminous metal sheet 12. The main area mats 13 are secured to the metal sheet 12 in like manner. By such fastening means, the overlay mat 10 is maintained securely against the metal sheet 12.

At the opposite end from the bridging portion 14 of the mats 9 and 13, the depending mat leg sections 9*a* terminate at approximately the lower edge of the frame member 11. For convenience, this dimension of the mat leg sections 9*a* is sometimes referred to herein as the "length of drape" of the depending insulation filler. The terminating end of the mat leg sections 9*a* fall short of meeting with the body of the heated metal container 41. More particularly, the container 41 has at its upper end a sill 42. The gap permitted by the impact assembly 15 between the upper sill surface 43 and depending mat legs 9*a*, typically no more than about a 10 mm. to 30 mm. gap, will permit some gaseous movement, e.g., offgassing from the molten metal present in the container 41, during covering of the container 41 by the cover assembly. Such release can be critical to obtaining extended life for the cover assembly mats 9 and 13 when the cover is used repeatedly and gas release from the container 41 can be frequently encountered. The cover assembly structure is thus most particularly useful in applications wherein an adjustment in compression in the impact assemblies 15, when combined with the length of drape of the insulation mats 9 and 13, can create this gap. This is a particularly advantageous, critical feature of the present invention, permitting ready adaptability of the cover to containers where gas release will be a consideration.

However, the convectional heat loss associated with this gap between the upper sill surface 43 and the terminating ends of the parallel mat legs 9*a* is typically minimal. Of far greater concern, is the heat loss associated with the radiant heat emanating upwardly from the inside metal container 41, as well as the heat loss due to convection, not only upwardly from inside the metal container 41, but also upwardly through the container sill 42. As will be appreciated by reference to FIG. 5, this heat loss is effectively blocked by the cover of the present invention. More particularly, the upward radiant and convection heat loss from inside the metal container 41 is virtually eliminated by the ceramic fiber main area mats 13 and overlay mat 10. Then the upward convection heat loss from the container sill 42 is most desirably retarded by the presence not only of the main area mats 13, but also by means of the perimeter mats 9 plus overlay mat 10.

This is another especially desirable feature of the present invention, i.e., the presence of insulation, e.g., perimeter mats 9, located above the container 41 structure itself. Although other structure is contemplated, it is preferred to size the cover such as to provide insulation mats directly above the container sill 42 adjacent the container aperture, as well as above the container aperture itself. Thus, convection heat loss from both sources is retarded. Moreover, as shown in FIG. 5, the preferred dimensions for the foot 18 of the impact assembly 15 provide for overlap on the container sill 42 outside the container, as opposed to overlapping the aperture of the container 41. By means of this preferred structure, placement of insulation perimeter mats 9 over the sill 42 is readily facilitated. Moreover, even for a flared or plate-shaped foot 18, little or no area of the foot 18 need rest over the aperture of the container 41.

As also shown most particularly in FIG. 5, the impact assembly 15 has an assembly housing 16 capped with a top ring 46. Extending through the assembly housing 16 and depending therefrom is the depending shaft 17 which penetrates into and terminates in a foot 18. Coiled around the shaft 17 and within the assembly housing 16 is a coil spring 47, shown in compressed position. Upwardly, the coil spring 47 pushed against a washer-like spacer plate 45 at the assembly top ring 46. In a downward direction, the coil spring 47 pushes against a retaining ring, or support cover element, 48 located on the depending shaft 17 above the foot 18. Also located between the retaining ring 48 and the foot 18, and positioned coaxially around the shaft 17, is a support member 49. The assembly housing 16 is securely affixed to the frame member 11, such as by welding. The depending shaft 17 is held within the housing 16 by means of nuts 51 tightened onto a threaded, or top leg, section 52 of the shaft 17 at least a part of which section is located above the top plate 46. As discussed in some detail hereinbefore, the tension on the coil spring is adjusted (and/or sufficient spacer plates 45 are used or are not used, as the case may be) so that when the foot 18 rests upon the container sill 42, whereby the impact assemblies 15 support the weight of the cover, there remains a gap for air movement between the upper sill surface 43 and the lower terminating ends of the mats 13 and 9.

Referring again to FIG. 1, it will be seen that as the heated metal container cover is being lowered over the container body, the cover will either be appropriately tilted by the counterweight 30 permitting the guide posts 21 nearest the counterweight 30 to contact the outer corner of the upper sill 41 as the cover is swung over the container body, or where the counterweight 30 is absent, the side lifting unit 33 can serve the same purpose. To enhance this contact, when the counterweight is used, the depending legs 22 of the guide means 21 adjacent the counterweight 30 can be of greater depending length than the legs 22 of the other guide means. As the cover is being appropriately guided, it will come to rest atop the container body by the resting of the impact assembly feet 18 upon the upper sill surface 43 of the container body. This covering operation can be generally accomplished, as by use of a crane, wherein the crane hook is engaged with the lifting bail 31 of the lifting unit 28. Upon placement of the cover over the container, the crane hook can be disengaged from the bail 31. The reverse operation, i.e., the lifting of the bail 31 of the lifting unit 28, such as with the hook from a crane, will easily remove the cover from the container. During such removal operation, the guide means 21 will serve to provide for efficient removal of the cover body without undue motion, e.g., without swaying or rotational oscillation of the cover.

Referring again to FIG. 1, it will be appreciated that the frame member 11 will typically be a rolled steel channel, but may be simply a steel plate, or a steel channel or a rolled plate or a rolled angle or the like, it being understood that other general cover configurations, e.g., rectangular or octagonal, could be used. The stiffening members 25 and 25*a* may also be of rolled plate or the like. The guide means 21 can be square shaped posts or rods and can project downwardly for any sufficient length that will augment guiding of the cover onto a container and will thereby otherwise support the cover, e.g., during resting of the cover, as on a floor. A multitude of guide means 21 can be provided on the frame member 11 including individual units positioned more closely to the central stiffener 26. Or just two guide means 21 positioned opposite the side lifting unit 33 can be useful. The guide means 21 can be single elements, without bracing, and can have straight edges, free from notched sections. A plurality of impact assemblies 15 can be secured to the frame member 11, and these can include assemblies 15 located closely adjacent the central stiffener 26. The resilient compression absorbing means depicted as a coil spring 47 within the housing 16 of each assembly 15 can include such means as air cylinders, leaf springs and spring washers to provide for the appropriate impact resiliency when placing the cover on a container. Such means within the housing 16 of each assembly 15 may also be adjustable, so as to create, eliminate or adjust any gap between a container sill 42 and the length of drape for the insulation filler.

For example, and referring more particularly to FIG. 5, the threaded section 52 above the assembly top plate 46 can be extended by adjustment of the nuts 51, thereby drawing the foot 18 closer to the assembly housing 16, or conversely separating them further apart. The threaded section 52 and nuts 51 can be replaced by other suitable leg length adjustment means, e.g., apertures in the shaft 17 coacting with locking pins. The support member 49 can be a pipe, a series of rods, a solid cylinder in contact with the depending shaft 17, or similar supporting structures. Moreover, the spacer plate 45 between the spring 47 and the top plate 46 can be optional, or several plates 45 can be used, for providing similar adjustment. As will be appreciated by referring to FIG. 5, it can be seen that the depending shaft 17 and foot 18 are not only free to move up and down, but are also free for rotational motion. In repeated use of the cover, this can lead to twisting and turning of the shaft 17 whereby differing portions of the foot 18 come to rest on an upper sill surface 43 of a container, thereby leading to more even wear and extended life for the foot 18.

Moreover, a variety of ceramic fiber insulation filler structures may be employed. For example, when mats are used, in addition to such being U-shaped or S-shaped, they can take other shapes, e.g., W-shaped, and such are most always interlocked when possible. During cover assembly, mat sections can be snugly pressed against the inner surface of the frame member 11 such that the perimeter mats 9 need not be used. Furthermore, the overlay mat 10 can be optional. The foraminous metal sheet 12 to which the ceramic fiber insulation filler is secured is typically a sheet of expanded metal mesh, although other foraminous coverings are contemplated, e.g., a plate containing a multitude of holes. The securing means for connecting the insulation to the foraminous metal sheet 10 may include any number of devices such as clips, J-shaped hooks and the like and the support rods 7 can be obviated by use of such techniques as pointed and piercing members running through the mats 9 and 13, with the members connected to the foraminous metal sheet 12. Many means are known in the art for securing ceramic fiber insulation filler to a wall-type structure such as provided by a foraminous metal sheet 12 or its equivalent, apertured wall-type structure, and it is contemplated that all such devices will be useful in the present invention.

The stiffening members 25 and 25*a* can be replaced by rods or used in connection with rods or any such suitable stiffening means for providing rigidity of the frame member 11, especially frame member sections 11*a* and 11*b* during cover assembly, or during disassembly of the cover for repair. It is to be understood that certain features are optional, e.g., the lifting unit 28, the side lifting unit 33, and the counterweight 30, or some can be replaced by equivalent devices. For example, the lifting unit 28 may be replaced by a pair of looped metal rods brought together at their apex for providing a loop structure which can be interengaged such as with the hook from a crane. Moreover, the lifting units 28 and 33 are virtually always used exclusive of one another.

Although the cover has been depicted in half sections 11*a* and 11*b* and in a generally curvilinear form, assemblies of more than two sections, as well as different shapes, e.g., the rectangular and octagonal shapes mentioned hereinbefore, are contemplated. Also, a sectioned or jointed cover may be obviated, such as where smaller covers of only three to four meters or so in length are needed. It is however most advantageous for best heat containment that where sections are employed in assembling the cover, that the foraminous metal sheet 12 be integrated so as to provide a continuous sheet 12 across the frame member 11.

Referring again to the ceramic fiber insulation filler, when adjacent filler units are in snug relationship, adjacent unit faces need not be woven together but may be held together in compression alone prior to securing to the foraminous metal sheet 12. However, it is preferred for best reduction of heat loss as well as securing of the filler within the frame member 11 that such adjacent faces be bound by any conventional technique, most preferably by weaving or stitching together. Groups of mats may be prewoven together into groups or modules, then secured as filler within the frame member. The support means for the insulation can be simple or complex and need be only sufficient to prevent the ceramic fiber insulation from falling away from the frame member 11 into the container located below. Although elements of the cover, other than the ceramic fiber insulation filler, have been generally referred to herein as metal elements, it will be appreciated that for certain structures lightweight ceramic materials may be suitable. However, the cover structure is preferably free from such materials as well as from the usual tile and refractory materials, e.g., bricks and other substantial ceramic materials, which are often found in heat insulating structures used in the metal heat treatment field. Furthermore, in addition to being tile-free and the like, the cover structure should also be mortar-free for best structural enhancement under a variety of insulation uses.

We claim:

1. A lightweight insulation cover adapted for retaining heat in a heated metal container, which cover comprises:

a frame member sized at least substantially to the upper aperture of a heated metal container;

ceramic fiber insulation filler in form-stable structural units within said frame member, there being units of different orientation within said frame member, said units including perimeter units positioned along the inner facing of said frame member and in snug relationship therewith;

a foraminous covering over said insulation filler;

securing means connecting said insulation filler to said foraminous covering; and stiffening members over said foraminous covering and affixed to said frame member.

2. The insulation cover of claim 1, wherein said frame member is comprised of rolled metal elements.

3. The insulation cover of claim 1, wherein said frame member has guide means with depending elements projecting downwardly away from said frame member for straddling engagement with the outer top of said container.

4. The insulation cover of claim 1, wherein said insulation perimeter units positioned along the inner facing of said frame member are in snug relationship with main insulation units abutting up against said perimeter units.

5. The insulation cover of claim 4, wherein said perimeter and main insulation units are covered with overlay insulation.

6. The insulation cover of claim 4, wherein said perimeter and main insulation units include structures of individual, folded U-shaped, S-shaped or W-shaped units.

7. The insulation cover of claim 1, wherein said foraminous covering is an open metal covering of expanded metal mesh.

8. The insulation cover of claim 1, wherein said securing means comprises insulation filler support elements in interengagement with said filler.

9. The insulation cover of claim 8, wherein said support elements include rods internally interengaging individual, folded units of insulation filler within the unit folds and said securing means includes a plurality of fastening elements connecting said rods to the foraminous covering.

10. The insulation cover of claim 1, wherein said stiffening members comprise an open metal framework spaced apart from said ceramic fiber insulation filler.

11. A covered ladle assembly adapted for retaining heat in an insulated cover, which heat is otherwise substantially lost by radiation and conduction, the ladle assembly comprising:

a ladle having an upper sill member terminating in an at least substantially flat upper sill surface that, together with a peripheral outer sill surface, forms a corner therebetween;

a cover frame member sized at least substantially to said peripheral outer sill surface and spaced apart from said upper sill surface;

frame member guide means having depending elements projecting downwardly away from said frame member and in straddling engagement with said corner of the sill;

ceramic fiber insulation filler in form-stable structural units within said frame member, there being units of different orientation within said frame member, said units including perimeter units positioned along the inner facing of said frame member and in snug relationship therewith; and support means for securing said insulation filler contained within said frame member.

12. A lightweight insulation cover adapted for retaining heat in a heated metal container, which cover comprises:

a frame member sized at least substantially to the upper aperture of a heated metal container;

ceramic fiber insulation filler in form-stable structural units within said frame member, there being units of different orientation within said frame member, said units including upper, overlay insulation structure positioned over secured units of said insulation filler;

a foraminous covering over said overlay insulation filler;

securing means connecting said secured units of insulation filler to said foraminous covering; and stiffening members over said foraminous covering and affixed to said frame member.

13. The insulation cover of claim 12, wherein said frame member has guide means with depending elements projecting downwardly away from said frame member for straddling engagement with the outer top of said container.

14. The insulation cover of claim 12, wherein said secured units of insulation filler include perimeter units positioned along the inner facing of said frame member.

15. The insulation cover of claim 14, wherein said secured units of insulation filler include main area insulation units abutting up against said perimeter units.

16. The insulation cover of claim 12, wherein said foraminous covering is an open metal covering of expanded metal mesh.

17. The insulation cover of claim 12, wherein said insulation units of different orientation include only said upper, overlay insulation structure plus underlying insulation units.

18. A covered ladle assembly adapted for retaining heat in an insulated cover, which heat is otherwise substantially lost by radiation and conduction, the ladle assembly comprising:

a ladle having an upper sill member terminating in an at least substantially flat upper sill surface that, together with a peripheral outer sill surface, forms a corner therebetween;

a cover frame member sized at least substantially to said peripheral outer sill surface and spaced apart from said upper sill surface;

frame member guide means having depending elements projecting downwardly away from said frame member and in straddling engagement with said corner of the sill;

ceramic fiber insulation filler in form-stable structural units within said frame member, there being units of different orientation within said frame member, said units including upper, overlay insulation structure positioned over secured units of said insulation filler; and support means for securing said insulation filler contained within said frame member.

19. The method of preparing a lightweight insulation cover adapted for retaining heat in a heated metal container, said cover having a frame member sized at least substantially to the upper aperture of said heated metal container, which method comprises:

positioning along the inner facing of said frame member perimeter units of ceramic fiber insulation filler in form-stable condition;

abutting main insulation units of ceramic fiber insulation against said perimeter units in snug relationship therewith;

covering said perimeter and main insulation units with a foraminous metal covering; and securing said perimeter and main insulation units to said foraminous covering.

20. The method of claim 19, wherein atop said frame member are stiffening members and said stiffening members are affixed to said frame member.

21. The method of claim 19, wherein said perimeter and main insulation units are supported by rods secured by a plurality of fastening elements connecting said rods to the foraminous metal covering.

22. The method of claim 19, wherein said perimeter and main insulation units are supported by rods secured to the foraminous metal covering by tie wires.

23. The method of claim 19, wherein said frame member is provided in half sections, with a foraminous metal covering extending beyond one frame member section while being recessed within an adjoining frame member section, whereby joining said sections establishes a jointed frame member having an interengaged foraminous metal covering.

24. The method of preparing a lightweight insulation cover adapted for retaining heat in a heated metal container, said cover having a frame member and foraminous metal covering, with said frame member being sized at least substantially to the upper aperture of said heated metal container, which method comprises:

positioning along the inner facing of said frame member perimeter units of ceramic fiber insulation filler in form-stable condition;

abutting main insulation units of ceramic fiber insulation against said perimeter units in snug relationship therewith;

covering said perimeter and main insulation units with overlay insulation; and securing said perimeter and main insulation units to said foraminous covering.

25. The method of claim 24, wherein securing said perimeter and main insulation units to said foraminous covering positions said overlay insulation against said covering.

26. The method of assembling a lightweight insulation cover adapted for retaining heat in a heated metal container, said cover having a sectional frame member and sectional foraminous metal covering, with said frame member being sized at least substantially to the upper aperture of said heated metal container, which method comprises:

forming a frame member section filled with units of ceramic fiber insulation filler in form-stable condition, with said frame member having a foraminous metal section covering including an extension section reaching beyond said frame member, with insulation filler extending beyond said metal covering extension section;

forming an adjoining frame member section, filled with said insulation filler, and having a foraminous metal section covering including a metal covering recess within said frame member, but with said insulation filler extending beyond said metal covering recess; and joining said frame member sections, bringing the extending insulation filler of each into contact, thereby compressing same, while bringing together said extension section and recess section of foraminous metal covering, thereby providing an interengaged foraminous metal covering for said joined frame member.

* * * * *